US005851315A

United States Patent [19]

Strathearn et al.

[11] Patent Number: 5,851,315

[45] Date of Patent: Dec. 22, 1998

[54] PROCESS FOR PRODUCING RADIOISOTOPE SOURCE

[75] Inventors: Gary Strathearn, Santa Monica; Seyed K. Taghizadeh, Los Angeles, both of Calif.

[73] Assignee: Iso-Science Laboratories, Inc., Burbank, Calif.

[21] Appl. No.: 895,092

[22] Filed: Jul. 16, 1997

[51] Int. Cl.[6] ..... C23C 8/36

[52] U.S. Cl. ..... 148/239; 250/303

[58] Field of Search ..... 148/239; 252/644, 252/645, 646; 250/303

[56] References Cited

U.S. PATENT DOCUMENTS

| | | | |
|---|---|---|---|
| 2,711,484 | 6/1955 | Knapp et al. | 250/303 |
| 3,378,498 | 4/1968 | Weatherley | 252/636 |
| 3,620,794 | 11/1971 | Fiqueroa | 427/5 |
| 3,700,602 | 10/1972 | Acree et al. | 252/645 |
| 3,859,179 | 1/1975 | Staples | 205/122 |
| 4,341,731 | 7/1982 | Mills, Jr. | 376/156 |

OTHER PUBLICATIONS

Agawala, R.P et al, Diffusion of Vanadium in Niobium, Zirconium and Vanadium, Acta Mettallungica, vol. 16, pp. 61–67, Jan. 1968.

Raether, F. et al, Magnetic Hyperfine Interaction After $^{77}$Br Implantation into Iron, Hyperfine Interactions 39(1988) 81–91.

*Primary Examiner*—Ngoclan Mai

*Attorney, Agent, or Firm*—Theodore J. Bielen, Jr.

[57] ABSTRACT

A process for implanting radioisotope ions into a substrate to create a radioisotope source, utilizing the chemical binding of selected ions to the surface of the substrate. Extraneous material not chemically bound to the substrate is removed and the chemically bound ions are diffused below the surface of the substrate in a non-oxidizing environment.

10 Claims, No Drawings

PROCESS FOR PRODUCING RADIOISOTOPE SOURCE

BACKGROUND OF THE INVENTION

The present invention relates to a novel and process and product involving implanted ions on a substrate which may be used as a radioisotope source.

It has been found that it is often advantageous to create a radioisotope source for the purpose of calibrating instruments, imaging patients in the medical environment, and providing treatment for medical disorders. For example, the labeling or implantation of radioisotopes in a substrate such as a metallic member may take the form of a radioactive stent which normally function as a metallic support within vascular, urological, and gastrointestinal applications. A recent medical development involves the prevention of restenosis or reocclusion of cardiac arteries after balloon angioplasty. Radioactive stents are employed in this area to deliver a small dose of radiation to attenuate the restenosis process.

In the past, production of radioisotope sources has involved the process of ion implantation. Although successful, ion implantation is slow and very costly to achieve. In addition, radioactive labeling has been accomplished by electroplating. However, such a process is not possible with all isotopes and often results in a non-uniform radioactive source. Electroplating is also quite costly.

A direct chemical method for implanting or inducing a radioactive isotope to a substrate would be a notable advance in the scientific research and medical fields.

SUMMARY OF THE INVENTION

In accordance with the present invention a novel and useful process for implanting or introducing radioactive isotopes to a substrate is herein provided.

The process of the present invention includes chemically binding ions to the surface of a substrate by dipping the substrate in a solution of the particular isotope to be used. For example, the substrate may be a metallic substance such as stainless steel, nitinol, copper, nickel, titanium, aluminum, silver, and the like. Moreover, the isotope ions implanted on the substrate may include phosphorous-32, strontium-90, yttrium-90, vanadium-48, chromium-51, and similar isotopes. Prior to the dipping or exposure of the surface of the substrate to the isotope, the surface may be prepared by electropolishing or chemical cleansing with acidic substances, organic solvents, and the like. The dipping may also occur in a pH adjusted bath commensurate with particular an isotope intended to be implanted on the substrate.

Following the chemical binding of the ions to the surface of the substrate, extraneous material is removed therefrom, leaving only the chemically bound material. Such removal is accomplished in many cases by washing and/or the application of further solvents. Of course, such step of removing the extraneous material does not disturb the chemically bound radioactive ions at the surface of the substrate.

The surface of the substrate is then heated to a selected temperature for a predetermined time period in a non-oxidizing environment. For example, the surface of the substrate may be heated between 300° and 600° centigrade for several hours in an oven containing hydrogen gas. Of course, the oven is prepurged for removal of oxidizing gases such as oxygen. The diffusing step then concludes with the substrate surface being cooled to room temperature in the reducing environment and washing of the same in a neutral solution. Sonication may also be employed in this washing step.

The labeling or implanting of radioactive ions in a substrate according the present invention may take place in a substrate of foil, or solid tubes of generally cylindrical configuration. In addition, it has been found that the labeling method of the present invention is accomplished on a stent, having an open lattice structure.

It may be apparent that a novel and useful product for labeling or implanting radioactive ions into a substrate has been described.

It is therefore an object of the present invention to provide a process for labeling substrates with radioactive ions that is reliable and relatively inexpensive to achieve.

Another object of the present invention is to provide a process for labeling substrate and producing a radioactive source, thereby, which may be employed in medical applications for the purposes of imaging.

A further object of the present invention is to provide a radioactive stent and a process for producing the same such that the radioactive stent may be employed to prevent restenosis following balloon angioplasty.

Yet another object of the present invention is to provide a process for producing a radioactive or radioisotope source which may be employed to calibrate instruments.

The invention posses other objects and advantages especially as concerns particular characteristics and features thereof which will become apparent as the specification continues.

DETAILED DESCRIPTION OF THE PREFERRED EMBODIMENTS

Various aspects of the present invention will evolve from the following detailed description of the preferred embodiments.

Process of the present invention employs the labeling for implanting of radioactive isotopes on metallic substrates such as copper, stainless steel, nickel, titanium, aluminum, silver, nitinol, gold, and the like. A wide range of nuclides is also used in the labeling process. For example, isotopes of phosphorous, strontium, yttrium, chromium, and vanadium may be implanted by the present process to produce a novel radioisotope product. It is also expected that other nuclides attach using the process of the present invention. Moreover, it is also believed that the process may be employed in non-metallic substrate in the same manner.

The process of the present invention utilizes a substrate which is normally prepared by electropolishing followed by washing with an acidic material such as nitric acid. The substrate is further cleaned with solvents such as ethanol and water to remove extraneous materials which may interfere with the implantation process.

The ion to be implanted is formed into a solution or bath such as a bath of phosphorous-32 combined with phosphoric and dilute hydrochloric acid. pH is adjusted to between 2 and 4 such that the concentration of the exemplary phosphorous-32 is greater than about 37 GBq/mL. Agitation and/or sonication may also be applied at this point to expose the material on the substrate to the bath of the radioactive isotope. Such exposure may be accomplished over a period of 3 to 24 hours.

The substrate is then removed from the bath and washed in organic and non-organic solvents such as water, ethanol, methanol, and the like. Such washing has been determined to not substantially remove the radioactive isotope, which is now chemically held to the surface of the substrate. The substrate surface is then heated in a non-oxidizing, preferably a reducing, atmosphere in an oven. For example, hydrogen gas may be employed for this purpose. Such heating may range from 300° to 800° centigrade and take place over a period of 2 to 24 hours. Following the heating step, the substrate is then cooled to room temperature and removed from the oven. The substrate is then washed in saline solution or similar solvents and may be sonicated to further clean the surface of the substrate. The wash is repeated as necessary until the removed substances are not present in a significant amount.

The process of the present invention may be employed to produce an actual stent which may then be applied in a medical use. For example, such use may include the heretofore noted treatment of the reocclusion of an artery following balloon angioplasty. Of course, the radioisotope source may be employed in other uses such as imaging, instrument calibration, and the like.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The following examples are intended to be illustrative of the invention and are not deemed to limit the invention in any aspect.

EXAMPLE 1

A stainless steel foil was prepared by electropolishing followed by washing in dilute nitric acid. The surface of the substrate was further cleaned with a mixture of ethanol and water to remove other materials. A bath of phosphorous-32, as phosphoric acid (orthophosphate), in dilute hydrochloric acid was prepared. The pH of the bath was adjusted to about 3, plus or minus 1 such that the concentration of the phosphorous-32 was no greater than 0.37 GBq/mL (10 mCi/mL). The surface of the substrate was exposed to the phosphorous-32 for at least 8 hours, although this time may be extended to 24 hours. Agitation and, optionally, sonication, may also be employed in the bath. Following this time period, the substrate was removed from the bath and washed with distilled water followed by a rinse in ethanol. The substrate was then placed in a high temperature oven at 500° centigrade for 4.5 hours, containing hydrogen gas. The oven was prepurged of oxidizing gases. The surface of the substrate was then cooled, following the heating step, in the hydrogen gas at room temperature. After removal from the oven, the substrate was washed in saline solution. Sonication was also applied in a cyclic fashion i.e. 15 minutes sonication, 15 minutes stagnant, followed by 15 minutes sonication. The wash and sonication process continued until the wash product contained less than 1% of the total activity of the substrate. The labeling of phosphorous-32 to stainless steel was repeated for solid tubes and on an actual stent.

The foil of nitinol was employed using a steps of the process found in Example 1 with respect to stainless steel, prior to heating. In the case of nitinol, the substrate was heated to 300° centigrade for 4.5 hours in an oven containing hydrogen gas. The nitinol substrate was then cooled in hydrogen gas at room temperature and washed clean according to the steps shown in Example 1. Phosphorous-32 was successfully implanted by this method.

By the same token, phosphorous-32 was successfully implanted on copper foil by heating to 600° centigrade for 4 hours in an oven containing hydrogen gas. The copper was cooled by quenching, i.e. placing the heating chamber into an ice bath. Washing took place according to the steps shown in Example 1, with respect to stainless steel, following the heating and cooling steps.

Phosphorous-32 was also implanted on nickel and aluminum foils using all the steps of Example 1, with respect to stainless steel.

Titanium was also labeled with phosphorous-32 using all the steps of Example 1, with respect to stainless steel, except the heating step. In the case of titanium, the substrate foil was heated to 600° centigrade for 4 hours in an oven containing hydrogen gas, followed by cooling to room temperature in the hydrogen gas.

EXAMPLE 2

Strontium-90 was successfully implanted on stainless steel foil by electropolishing the foil followed by a wash of dilute nitric acid. The foil was further cleaned with an ethanol/water mixture to remove extraneous materials. A strontium-90 bath was prepared using strontium chloride as the source of strontium-90 and a dilute hydrochloric acid solution. The pH of the bath was adjusted to 3, plus or minus 1 in a concentration of greater than 0.37 GBq/mL (10 mCi/mL). The substrate was exposed to the bath for at least 8 hours, and it is believed the both could be exposed up to 24 hours, with agitation. Although sonication was not employed it is believed that this could take place during this step. The stainless steel foil was then removed from the bath and washed with distilled water followed by ethanol. Heating took place in an oven of hydrogen gas at a temperature of 500° centigrade for 4.5 hours. Following the heating, the substrate was cooled in hydrogen gas to room temperature. The stainless steel substrate was then washed with saline solution and sonicated similarly to the sonication cycle described in Example 1, with respect to stainless steel.

The implanting or labeling of strontium-90 was also repeated for a nitinol foil substrate using the steps of Example 2, with respect to stainless steel, except for the heating step. In the case of nitinol, the substrate was heated to 300° for 4.5 hours in the oven filled with hydrogen gas.

Strontium-90 was also successfully implanted on copper foil following the steps of Example 2, with respect to stainless steel, except for the heating step. In the case of copper, the surface was heated to 600° centigrade for 4 hours in the oven filled with hydrogen gas.

Strontium-90 was also successfully implanted on nickel and silver foils following the steps of Example 2 with respect to stainless steel.

Strontium-90 was also labeled on titanium foil following the steps of Example 2, with respect to stainless steel, except that the surface of the titanium was heated to 600° centigrade for 4 hours in an oven filled with hydrogen gas.

EXAMPLE 3

Yttrium-90 was successfully implanted or labeled on stainless steel foil and solid tubes. The stainless steel substrates were prepared by electropolishing followed by a wash of dilute nitric acid. The nitric acid was removed in a distilled water wash, followed by a wash of dilute hydrochloric acid. The substrate was further cleaned with an ethanol/water mix to remove other materials. Yttrium-90, as yttrium chloride, was placed in a dilute hydrochloric acid bath with the pH adjusted to 3 plus or minus 1. The concentration of yttrium was greater than 0.37 MBq/mL (10 mCi/mL). It was found that the use of nitric acid in this system hampered the implantation process of yttrium-90 on stainless steel. The stainless steel substrates were then exposed to the bath for at least 8 hours with agitation and/or sonication. After removal from the bath, the stainless steel was washed with distilled water followed by cleansing with ethanol. The substrate was then placed in an oven filled with hydrogen gas and heated to 500° centigrade for 4 to 5 hours. Following the heating step, the substrate was cooled in the hydrogen gas to room temperature. The substrate was then removed from the oven and was washed in a saline solution with a sonication cycle similar to that described in Example 1, with respect to stainless steel, following the heating step.

Yttrium-90 was successfully diffused or implanted into nitinol foil and tubes utilizing the steps of Example 3, with respect to stainless steel, except for the heating step. In the case of nitinol, the substrate foil and tubes were heated to 300° centigrade for 4.5 hours in an oven filled with hydrogen gas. The nitinol was cooled in the hydrogen gas in the oven prior to removal.

Yttrium-90 was successfully diffused or implanted on silver foil utilizing the method of Example 3, with respect to stainless steel.

EXAMPLE 4

Vanadium-48 was successfully implanted into a stainless steel foil substrate. The foil surface was prepared by electropolishing followed by wash with dilute nitric acid. Further cleaning took place with an ethanol/water mix to remove other materials. The substrate was then placed in a bath of vanadium-48, which was prepared using vanadium chloride as the source and a dilute hydrochloric acid. The pH of the bath was adjusted to 2.5 plus or minus 1. Vanadium-48 was present at a concentration of greater than 0.37 MBq/mL (10 mCi/mL). After exposure to the vanadium-48 bath for at least 8 to 12 hours, with agitation and/or sonication, the substrate was removed. Washing with distilled water in ethanol, followed this cleaning step. The substrate was placed in a hydrogen gas atmosphere in an oven and heated to 600° centigrade for 4.5 hours. The substrate was cooled in hydrogen gas to room temperature. Following the cooling, the substrate was washed in saline solution with a sonication cycle similar to that described in Example 1, with respect to stainless steel.

Vanadium-48 was successfully implanted into nitinol foil following the steps of Example 4, with respect to stainless steel, except for the heating step. Heating took place in hydrogen gas within an oven at 300° centigrade for 4.5 hours.

Vanadium-48 was successfully implanted on copper foil following the steps of Example 4 with respect to stainless steel. The exception is that the heating step took place at 600° centigrade for 4 hours in hydrogen gas in the oven. The substrate was cooled by quenching, i.e. by placing the heating chamber into an ice bath.

Vanadium-48 was successfully implanted on nickel foil following the steps of Example 4, with respect to stainless steel.

EXAMPLE 5

The implantation of cesium-137 on stainless steel and other metals was attempted using the steps shown in Example 1. Such implantation was unsuccessful.

What is claimed is:

1. A process for implanting radioactive ions to a substrate having a surface, comprising;

a. chemically binding selected radioactive ions to the surface of the substrate;

b. removing extraneous material not chemically bound to the substrate surface; and c. diffusing the chemically bound radioactive ions below the surface of the substrate in a non-oxidizing environment.

2. The process of claim 1 which further comprises the step of removing selected ions that have not diffused below said surface of the substrate, after said step of diffusing the chemically bound ions below the surface of the substrate.

3. The process of claim 1 which further comprises the step of activating the surface of the substrate for aiding in said chemical binding of selected ions thereto prior to said step of chemically binding selected ions to the surface of the substrate.

4. The process of claim 1 in which said step of diffusing the chemically bound ions below the surface of the substrate is performed in a reducing environment.

5. The process of claim 1 in which said step of diffusing the chemically bound ions below the surface of the substrate includes the addition of heat to said substrate.

6. The process of claim 1 in which the radioactive ions are selected from the group comprising: phosphorous-32, strontium-90, yttrium-90, vanadium-48, and chromium-51.

7. The process of claim 1 in which the substrate is selected from the group comprising: stainless steel, nitinol, copper, nickel, titanium, silver, and aluminum.

8. The process of claim 5 in which said heat as applied between 300° and 600° centigrade.

9. The process of claim 5 which additionally comprises the step of cleaning the substrate surface following said step of diffusing the chemically bound radioactive ions below the surface of the substrate.

10. The process of claim 9 in which said step of cleaning the substrate surface following said step of diffusing, includes the step of sonication.

* * * * *